US005146022A

United States Patent [19]

Buchanan et al.

[11] Patent Number: 5,146,022

[45] **Date of Patent: * Sep. 8, 1992**

[54] HIGH VI SYNTHETIC LUBRICANTS FROM CRACKED SLACK WAX

[75] Inventors: J. Scott Buchanan, Hamilton Square; Margaret M. Wu, Belle Mead, both of N.J.

[73] Assignee: Mobil Oil Corporation, Fairfax, Va.

[ * ] Notice: The portion of the term of this patent subsequent to Aug. 4, 2009 has been disclaimed.

[21] Appl. No.: 571,345

[22] Filed: Aug. 23, 1990

[51] Int. Cl.[5] ..... C10L 1/16; C10L 5/00; C07C 2/02

[52] U.S. Cl. ..... 585/12; 585/7; 585/10; 585/11; 585/255; 585/530; 585/532; 208/106

[58] Field of Search ..... 585/530, 532, 255, 7, 585/10, 11, 12; 208/106

[56] References Cited

U.S. PATENT DOCUMENTS 2,642,466 6/1953 Garner et al. .
2,945,076 7/1960 Pardee .
3,103,485 9/1963 Cahn .
3,705,926 12/1972 Rumpf et al. .
4,042,488 8/1977 Perciful .
4,395,578 7/1983 Larkin .
4,420,646 12/1983 Darden et al. .

FOREIGN PATENT DOCUMENTS 1323353 7/1973 United Kingdom .

*Primary Examiner*—Patrick P. Garvin
*Assistant Examiner*—E. D. Irzinski
*Attorney, Agent, or Firm*—Alexander J. McKillop; Charles J. Speciale; Malcolm D. Keen

[57] ABSTRACT

A process is disclosed for the production of synthetic lubricants having high viscosity index and thermal stability by oligomerizing a mixture of $C_5$–$C_{18}$ or $C_6$–$C_{16}$ alpha-olefins produced from the thermal cracking of slack wax or recycled slack wax. The oligomerization is carried out with Lewis acid catalyst. Promoted aluminum chloride is a preferred catalyst.

17 Claims, No Drawings

HIGH VI SYNTHETIC LUBRICANTS FROM CRACKED SLACK WAX

This invention relates to a process for the production of synthetic lubricants from thermally cracked slack wax. In particular, the invention relates to the production of high viscosity index (VI) synthetic lubricants by the oligomerization of the olefinic reaction product obtained by thermally cracking slack wax. The lubricants so obtained are further distinguished by their superior thermal stability.

BACKGROUND OF THE INVENTION

Mineral oil based lubricants are conventionally produced by a separative sequence carried out in the petroleum refinery which comprises fractionation of a paraffinic crude under atmospheric pressure followed by fractionation under vacuum to produce distillate fractions (neutral oils) and a residual fraction which, after deasphalting and severe solvent treatment may also be used as a lubricant base stock usually referred as a bright stock. Neutral oils, after solvent extraction to remove low viscosity index (V.I.) components are conventionally subjected to dewaxing, either by solvent or catalytic dewaxing processes, to the desired pour point, after which the dewaxed lube stock may be hydrofinished to improve stability and remove color bodies. This conventional technique relies upon the selection and use of crude stocks, usually of a paraffinic character, which produce the desired lube fractions of the desired qualities in adequate amounts. The range of permissible crude sources may, however, be extended by the lube hydrocracking process which is capable of utilizing crude stocks of marginal or poor quality, usually with a higher aromatic content than the best paraffinic crudes. The lube hydrocracking process, which is well established in the petroleum refining industry, generally comprises an initial hydrocracking step carried out under high pressure in the presence of a bifunctional catalyst which effects partial saturation and ring opening of the aromatic components which are present in the feed. The hydrocracked product is then subjected to dewaxing in order to reach the target pour point since the products from the initial hydrocracking step which are paraffinic in character include components with a relatively high pour point which need to be removed in the dewaxing step.

Current trends in the design of automotive engines are associated with higher operating temperatures as the efficiency of the engines increases and these higher operating temperatures require successively higher quality lubricants. One of the requirements is for higher viscosity indices (V.I.) in order to reduce the effects of the higher operating temperatures on the viscosity of the engine lubricants. High V.I. values have conventionally been attained by the use of V.I. improvers e.g. polyacrylates, but there is a limit to the degree of improvement which may be effected in this way; in addition, V.I. improvers tend to undergo degradation under the effects of high temperatures and high shear rates encountered in the engine, the more stressing conditions encountered in high efficiency engines result in even faster degradation of oils which employ significant amounts of V.I. improvers. Thus, there is a continuing need for automotive lubricants which are based on fluids of high viscosity index and which are stable to the high temperature, high shear rate conditions encountered in modern engines.

Synthetic lubricants produced by the polymerization of alpha olefins in the presence of certain catalysts have been shown to possess excellent V.I. values, but they are expensive to produce by conventional synthetic procedures and usually require expensive starting materials. There is therefore a need for the production of high V.I. lubricants from mineral oil stocks which may be produced by techniques comparable to those presently employed in petroleum refineries.

It is well known that alpha olefins useful in the preparation of synthetic lubricants can be produced by the ethylene growth reactions or by cracking petroleum waxes, including slack wax. Typically, the products of ethylene growth reaction or wax cracking are separated by distillation to recover the $C_{10}$ fraction known to be especially useful in the production of the sought for high VI synthetic lubes. Oligomers of 1-alkenes from $C_6$ to $C_{20}$ have been prepared with commercially useful synthetic lubricants from 1-decene oligomerization yielding a distinctly superior lubricant product via reduced chromium, cationic or Ziegler catalyzed polymerization.

Discovering exactly those alpha olefins, and the associated oligomerization process, that produce a preferred and superior synthetic lubricant meeting the specification requirements of wide-temperature fluidity while maintaining low pour point represents a prodigious challenge to the workers in the field. Brennan, Ind. Eng. Chem. Prod Res. Dev. 1980, 19, 2–6, cites 1-decene trimer as an example of a structure compatible with structures associated with superior low temperature fluidity wherein the concentration of atoms is very close to the center of a chain of carbon atoms. Also described therein is the apparent dependency of properties of the oligomer on the oligomerization process, i.e., cationic polymerization or Ziegler-type catalyst, known and practiced in the art. While theoretical considerations abound as to the relationship between alpha olefin structure and the lubricant properties that will ensue from oligomerization thereof, the art is, as yet, unpredictable and a relatively expensive 1-alkene, i.e., 1-decene, is commercially relied upon to provide high VI synthetic lubricant.

In U.S. Pat. No. 4,395,578 to Larkin, a process is described for the oligomerization of alpha-olefins using boron trifluoride catalyst wherein the alpha-olefins are produced by ethylene polymerization or wax pyrolysis. Viscosity indices up to 112 are achieved.

In U.S. Pat. No. 4,420,646 to Darden et al, a process is described for the production of synthetic lubricants by the oligomerization of alpha-olefins produced from wax pyrolysis. Boron trifluoride catalyst providing viscosity indices of about 130 are reported. These processes do not disclose the oligomerization of the reaction mixture from slack wax cracking.

It is an object of the present invention to prepare high viscosity index lubricants from inexpensive refinery hydrocarbon products.

It is another object of the invention to prepare such lubricants that also exhibit low pour point and superior thermal stability.

A further object of the invention is to prepare such lubricants using slack wax as the feedstock.

Another object of the invention is to prepare such lubricants in high yield by the catalytic oligomerization of the product mixture of olefins recovered from thermally cracking slack wax.

SUMMARY OF THE INVENTION

We have discovered a process for the production of synthetic lubricants having high viscosity index and thermal stability by oligomerizing a mixture of alpha-olefins produced from the thermal cracking of slack wax. The oligomerization is carried out with Lewis acid catalyst.

The process comprises contacting the olefinic hydrocarbon product mixture from the thermal cracking of slack wax with Lewis acid catalyst under oligomerizing conditions and separating a product comprising synthetic lubricant having a kinematic viscosity greater than 2 cS at 100° C., pour point less than −15° C. and VI greater than 120. The product is hydrogenated in contact with hydrogenation catalyst and a hydrogenated lubricant recovered having improved thermal stability.

More particularly, the process comprises thermally cracking slack wax to produce an olefinic hydrocarbon mixture comprising a major portion of linear alpha olefins; separating the mixture to produce $C_5$–$C_{17}$ or $C_6$–$C_{16}$ hydrocarbon mixtures comprising predominantly linear alpha olefins; oligomerizing the $C_5$–$C_{17}$ or $C_6$–$C_{16}$ mixture in contact with promoted aluminum chloride catalyst; recovering a $C_{30}$+ oligomerization product comprising a synthetic lubricant having a kinematic viscosity greater than 2 cS at 100° C. and VI greater than 120; hydrogenating the oligomerization product to provide synthetic hydrocarbon lubricant having thermal stability comprising less than 15% viscosity loss upon cracking at 280° C. for 24 hours.

DETAIL DESCRIPTION OF THE INVENTION

Current synthetic hydrocarbon lubricants are prepared by polymerization of alpha olefins, such as 1-decene or mixtures of 1-octene to 1-dodecene produced from ethylene growth reaction. Prior to the advent of the ethylene growth process thermal cracking of refined wax or slack wax produced alpha olefins which were separated from the crackate and polymerized by boron trifluoride catalyst to provide synthetic lubricants. Slack wax is a relatively inexpensive petroleum refinery commodity which could uncouple synthetic lube production from a dependency on ethylene growth reaction and thereby lower product cost, but only if it can be used as feedstock to produce synthetic lubricants in high yield and of a quality equal to or better than those produced from ethylene growth reaction. Prior art processes have involved costly fractionation of wax crackate to provide 1-decene or narrow distributions of alpha olefins with an average carbon number of about 10 for oligomerization to quality lubes using $BF_3$ catalyst. These costly separation steps and their consequent reduction of usable crackate have negated the value of slack wax as a feedstock for 1-alkenes for synthetic lube production.

As described hereinafter, it has now been discovered that slack wax, when thermally cracked at high temperature, yields a crackate containing predominately alpha olefins. When a broad mixture of alpha olefins is recovered from the crackate and oligomerized with promoted aluminum chloride a high quality synthetic lubricant is produced characterized by a high viscosity index and low pour point. Surprisingly, it has been found that the high viscosity lube produced by $AlCl_3$ catalyzed oligomerization of the mixture of alpha olefins show superior lube properties, including high VI. It is thought that these high viscosity materials are less sensitive to the properties of the starting alpha olefins. Hence, superior lubes are produced from a mixture of alpha olefins. Upon hydrogenation using methods well known in the art, the particularly surprising discovery has been made that the synthetic lube of the instant invention has a thermal stability distinctly superior than prior art commercially useful synthetic lubricant produced from materials such as 1-decene.

While not wishing to be bound by theoretical considerations, it is thought that several factors relating to slack wax composition and to the process employed in the instant invention combine to produce the surprising results achieved with respect to the production of a high VI synthetic lube exhibiting superior thermal stability. First, it is thought that the thermal cracking process carried out on slack wax results in considerably less isomerization and branching of alpha olefins compared to catalytic cracking. Since it is known that a relationship exists between branch ratio in a lube ligomer and VI, there is a strong indication of a relationship between the structure of the alpha olefins produced by the thermal cracking process of this invention and the high VI of the lube oligomer produced therefrom.

Second, slack wax contains aromatics which in the instant process are carried over in the product mix of alpha olefins that are oligomerized to high VI lube using Lewis acid catalyst. It is thought that these aromatics are incorporated into the oligomer molecule, perhaps as end groups, and there provide the enhancement to thermal stability that is a recognized capability of aromatics when added to lubes. But whether for these or other yet to be determined reasons, the unexpected results of the process are evident.

Feed

The feed to the process comprises a petroleum slack wax or recycled slack wax which contains between 10 and 50 weight percent oil, as determined by ASTM test D-3235 and ASTM test D-721. In these feeds of mineral oil origin, the waxes are mostly paraffins of high pour point, comprising straight chain and slightly branched chain paraffins such as methylparaffins.

Petroleum waxes, that is, waxes of paraffinic character are derived from the refining of petroleum and other liquids by physical separation from a wax-containing refinery stream, usually by chilling the stream to a temperature at which the wax separates, usually by solvent dewaxing, e.g., MEK/toluene dewaxing or by means of an autorefrigerant process such as propane dewaxing. These waxes have high initial boiling points above about 650° F. (about 345° C.) which render them extremely useful for processing into lubricants which also require ah initial boiling point of at least 650° F. (about 345° C.) The presence of lower boiling components is not to be excluded since they will be removed together with products of similar boiling range produced during the processing during the separation steps which follow the characteristic processing steps. Since these components will, however, load up the process units they are preferably excluded by suitable choice of feed cut point. The end point of wax feeds derived from the solvent dewaxing of neutral oils i.e. distillate fractions produced by the vacuum distillation of long or atmospheric resids will usually be not more than about 1100° F. (about 595° C.) so that they may normally be classified as distillate rather than residual streams but high boiling wax feeds such as petroleum waxes i.e. the waxes separated from bright stock dewaxing, which may typically have an end point of up to about 1300° F. (about 705° C.), may also be employed.

The wax content of the feed is high, generally at least 50, more usually at lest 60 to 80, weight percent with the balance from occluded oil being divided between aromatics and naphthenics. The non-wax content of aromatics, polynaphthenes and highly branched naphthenes will normally not exceed about 40 weight percent of the wax and preferably will not exceed 25 to 30 weight percent. These waxy, highly paraffinic wax stocks usually have low viscosities because of their relatively low content of aromatics and naphthenes although the high content of waxy paraffins gives them melting points and pour points which render them unacceptable as lubricants without further processing.

Feeds of this type will normally be slack waxes, that is, the waxy product obtained directly from a solvent dewaxing process, e.g. an MEK or propane dewaxing process. The slack wax, which is a solid to semi-solid product, comprising mostly highly waxy paraffins (mostly n- and mono-methyl paraffins) together with occluded oil, may be fed directly to the first step of the present processing sequence as described below without the requirement for any initial preparation, for example, by hydrotreating.

The compositions of some typical waxes are given in Table 1 below.

TABLE 1

| Wax Composition - Arab Light Crude | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

A typical slack wax feed has the composition shown in Table 2 below. This slack wax is obtained from the solvent (MEK) dewaxing of a 300 SUS (65 cST) neutral oil obtained from an Arab Light crude subjected to successive catalytic and solvent dewaxing.

TABLE 2

| Slack Wax Properties | | |
|---|---|---|
| API | | 39 |
| Hydrogen, wt. pct. | | 15.14 |
| Sulfur, wt. pct. | | 0.18 |
| Nitrogen, ppmw | | 11 |
| Melting point, °C. (°F.) | | 57 (135) |
| KV at 100° C., cST | | 5.168 |
| PNA, wt. pct: | | |
| Paraffins | | 70.3 |
| Naphthenes | | 13.6 |
| Aromatics | | 16.3 |
| Simulated Distillation: | | |
| % | °C. | (°F.) |
| 5 | 375 | (710) |
| 10 | 413 | (775) |
| 30 | 440 | (825) |
| 50 | 460 | (860) |
| 70 | 482 | (900) |
| 90 | 500 | (932) |
| 95 | 507 | (945) |

Another slack wax suitable for use in the present process has the properties set out in Table 3 below. This wax is prepared by the solvent dewaxing of a 450 SUS (100 cS) neutral raffinate:

TABLE 3

| Slack Wax Properties | |
|---|---|
| Boiling range, °F. (°C.) | 708-1053 (375-567) |
| API | 35.2 |
| Nitrogen, basic, ppmw | 23 |
| Nitrogen, total, ppmw | 28 |
| Sulfur, wt. pct. | 0.115 |
| Hydrogen, wt. pct. | 14.04 |
| Pour point, °F. (°C.) | 120 (50) |
| KV (100° C.) | 7.025 |
| KV (300° F., 150° C.) | 3.227 |
| Oil (D 3235) | 35 |
| Molecular wt. | 539 |
| P/N/A: | |
| Paraffins | — |
| Naphthenes | — |
| Aromatics | 10 |

Other useful slack waxes in the present invention are an Adelaide Medium Neutral slack wax with properties shown in Table 4 and a Beaumont light neutral slack wax with properties shown in Table 5.

TABLE 4

| | |
|---|---|
| Mol. Wt. (1524) | 453 |
| API gravity: | 37.7 |
| Oil content (D3235) | 15% wt % |
| Mass Spec. Analysis (M1085) | wt % |
| paraffins | 78.5 |
| mononaphthenes | 8.3 |
| polynaphthenes | 4.8 |
| aromatics | 8.4 |

TABLE 5

| | |
|---|---|
| Mol. Wt. (M1524) | 338 |
| Oil content (D3235) | 16.3% wt % |
| Mass Spec. Analysis (M1085) | wt % |
| paraffins | 84.9 |
| mononaphthenes | 4.4 |
| polynaphthenes | 6.9 |
| aromatics | 3.8 |

Thermal Cracking

An important aspect of the present invention is that the slack wax feedstock is thermally cracked under conditions suitable for the production of a crackate, or product of the cracking process, containing predominantly alpha olefins. Thermal cracking is well known in the refinery art and the present thermal cracking process can be carried out in a variety of process configurations, continuous or batch-wise. Typically, the hot wax is feed to the top of a vertical reactor containing vycor chips or other inert material. The wax is effectively cracked at a temperature between about 950° F. and 1200° F. (510° C.-648° C.) and a pressure between about 50 kPa and 980 kPa at a liquid hourly space velocity (LHSV) between about 0.3 and 20. A preferred cracking temperature is about 590° C. and a preferred pressure is about 103 kPa at a LHSV of about 2. In practice, the wax feed is typically diluted with 1 to 70 percent by volume of an inert gas such as nitrogen or steam. Following thermal cracking the cracking product is fractionally distilled and fractions having carbon number between five and eighteen collected and combined as feedstock for subsequent polymerization to synthetic lubricant.

Oligomerization

The oligomerization feedstock mixture typically comprises a $C_5$–$C_{18}$ fraction or $C_6$–$C_{16}$ fraction of olefinic hydrocarbons from fractionation of the thermal cracking product. A preferred fraction is $C_6$–$C_{17}$ olefinic hydrocarbons. It has been found that using a narrower cut of olefinic hydrocarbons can improve the lube product properties, but at the cost of reducing lube yields. Decreasing the amount of $C_5$–$C_6$ hydrocarbons in the oligomerization feedstock generally boosts the VI of the lube product, and decreasing the amount of $C_{16}$–$C_{18}$ generally improves lube pour point. However, in the present invention it has been found that using a feedstock comprising $C_5$–$C_{18}$ or $C_6$–$C_{16}$ hydrocarbons provides lube products with surprisingly high VI. Prior to oligomerization the feedstock is purified to remove moisture and oxygenated organic compounds such as alcohols, ethers, peroxides and esters which would interfere with the oligomerizations process. Oligomerization is carried out using a Lewis acid catalyst such as aluminum chloride, boron trifluoride, $SnCl_4$ and the like. A promoted aluminum chloride is the preferred catalyst. Effective promoters for use with Lewis acids include those well known in the art and particularly protonic promoters such as alcohols, carboxylic acids or water. With aluminum chloride as used in the present invention water is an effective promoter. Generally, the mole ratio of $AlCl_3$ to water added as promoter is between 10 and 0.1. A mole ratio of about 1 to 2 is preferred.

The oligomerization may be carried batch-wise or continuous; neat or in solution. Useful solvents include non-reactive hydrocarbons, particularly paraffinic materials such as cyclohexane, octane or higher hydrocarbons. The process is carried out under oligomerization conditions comprising temperature between about 0° C. and 250° C. for a time sufficient to produce the synthetic lubricant. A wide range of pressures can be used, but typically between 1000 kPa and 35 kPa. Preferably, the oligomerization is carried out at about atmospheric pressure (102 kPa). Less than 10 weight percent of catalyst is employed, based on olefin in the feedstock, but higher amounts may be used. Preferably, about five weight percent of $AlCl_3$ catalyst is used, based on olefin.

Following the oligomerization step the catalyst is removed by washing with dilute acid, base and water and the organic product is separated by distillation to remove components boiling below 400° C. The product recovered has a kinematic viscosity measured at 100° C. between above 4 cS and 200 cS, a viscosity index above 120 and a pour point below −15° C.

According to the practice typical in the petroleum lubricant arts the product is hydrogenated to saturate residual olefinic bonds. Hydrogenation can be carried out by any of numerous methods well known to those skilled in the art. A preferred method is to hydrogenate the product at elevated temperature and pressure in contact with Pd or Pt on charcoal. It has been discovered that when the hydrogenated product is tested for thermal stability by heating at 280° C. under nitrogen for 24 hours and the results compared to those achieved by synthetic lube produced by oligomerization of mixtures of alpha olefins from ethylene growth reaction or by oligomerization of 1-decene the product of this invention shows a substantially higher thermal stability.

In the following Examples the process of the invention is specifically described and the characterization of the products depicted.

EXAMPLE 1

Thermal Cracking

A standard stainless steel laboratory reactor filled with about 45 $cm^3$ of 4/16 mesh vycor chips was used for thermal cracking of Adelaide medium neutral slack wax at atmospheric pressure. Approximately 50 ml/hr of wax was fed from an Isco pump to the top of the reactor along with 30 SCCM nitrogen. The product recovery train consisted of a 120° C. receiver and a 0° C. condenser.

Five six-hour cracking runs were made with the slack wax at a nominal reaction temperature of 590° C. Product yields are listed in Table 6. The liquids collected in the condenser for the five slack wax cracking runs were combined and then fractionated under 0.05–0.1 torr pressure into five fractions whose properties are listed in Table 7.

TABLE 6

| Adelaide Slack Wax Cracking Products | |
|---|---|
| Cracking Temp., °C. | 590 |
| $C_{19}$+ conversion, Wt % | 47.1 |
| Wt % yields: | |
| $C_4$− | 13.3 |
| $C_5$–$C_6$ | 6.3 |
| $C_7$–$C_{17}$ | 25.2 |
| $C_6$ LAO Purity*, wt % | 78 |
| Wt % selectivities: | |
| $C_1$ | 2.5 |
| $C_2$ | 4.5 |
| $C_2$= | 8.1 |
| $C_3$ | 1.0 |
| $C_3$= | 6.1 |
| $C_4$ | 0.2 |
| $C_4$= | 3.7 |
| $C_4$== | 1.2 |
| $C_5$'s | 4.7 |
| $C_6$'s | 8.8 |
| $C_7$–$C_{17}$ | 53.5 |

*$C_6$ LAO (linear alpha olefin) purity is the percent normal 1-hexene present in the $C_6$ fraction.

Fractions 1–3, composed of $C_6$–$C_{16}$ species were combined and purified over 13X molecular sieve and Deox catalyst (reduced copper chromite) to remove moisture and oxygenates before use in lube synthesis. Samples of the purified olefin mixture were oligomerized by promoted aluminum chloride catalyst.

TABLE 7

Properties of Fractions Distilled from Cracked Wax

| Fraction | 1 | 2 | 3 | 4 | 5 |
|---|---|---|---|---|---|
| Fractionation Temp., °C. @ 0.1 mmHg | 25–32 | 32–41 | 42–52 | 55–78 | 70–90 |
| Yields, Wt % of feed | 4.1 | 2.6 | 4.5 | 3.7 | 4.6 |
| Average MW by GC Analysis | 115 | 154 | 178 | 215 | 215 |
| Average MW by bromine No. | 126 | 143 | 166 | 204 | 225 |
| Average Carbon Number | 8.23 | 10.97 | 12.72 | 15.33 | 15.32 |

Oligomerization

Anhydrous aluminum chloride powder, 1.2 g, was added to the olefin mixture, 20 grams, produced in Example 1, containing 150 micro-liter water and preheated to 50° C. under nitrogen. The reaction mixture was stirred at 50° C. for 16 hours. The aluminum chloride catalyst was destroyed by washing with 30 cc dilute HCl, dilute NaOH and water. The organic product was dried and distilled to remove light components boiling below 750° F. The lube product was then hydrogenated at 100° C. and 400 psi with 2 wt. % Pd (5%) on activated carbon catalyst for four hours.

The $C_5$–$C_{17}$ product from slack wax cracking was over 90% olefins, as indicated by bromine number and gc compositions.

For comparison, pure 1-decene and a $C_6$–$C_{14}$ linear alpha-olefin mixture with an average carbon number of 9.5 and a distribution similar to the product from commercial ethylene growth process were oligomerized. The following Table 8 presents a comparison of the product properties of PAOs, polyalphaolefins, derived from slack wax cracking as in the instant invention with other comparative sources. Detailed reaction conditions and lube yields are summarized in Table 9.

TABLE 8

| Olefin Feed | V100 cS | VI | Pour Point °C. | % Visc Loss @ 280° C. |
|---|---|---|---|---|
| Slack wax cracking | 45.13 | 126 | — | 12 |
| Slack wax cracking | 49.50 | 128 | −40 | 3 |
| $C_6$–$C_{14}$ olefins from $C_2^=$ growth | 47.70 | 143 | −45 | 25 |
| 1-decene | 43.08 | 149 | −34 | 23 |

TABLE 9

| Olefin Source | $AlCl_3$ Wt % | $AlCl_3/H_2O$ mole ratio | Yield by gc, wt % | V @ 100° C. cS |
|---|---|---|---|---|
| slack wax | 2 | 1.7/1 | NA | 26.50 |
| slack wax | 6 | 5.1/1 | NA | 45.13 |
| slack wax | 6 | 5.1/1 | 99 | 49.50 |
| $C_6$–$C_{14}$* | 6 | 5.1/1 | 99 | 47.7 |
| 1-decene | 2 | 1.7/1 | NA | 43.08 |

*alpha-olefin mixture, average carbon number = 9.5

Lube-range product of approximately 40 cS was obtained with 6% $AlCl_3$. The product had a comparable VI (126–128) to the lube product from either a pure $C_6$–$C_{14}$ alpha-olefin mixture (143) or from 1-decene (149).

The product derived from olefins from slack wax cracking showed better thermal stability than lubes made from more pure alpha-olefins: the slack wax product suffered only 3–12% viscosity loss after thermal treatment at 280° C. as opposed to 23% for 1-decene PAO, 25% for lube made from the $C_6$–$C_{14}$ mix of pure alpha-olefins.

EXAMPLE 2

Light neutral slack wax containing 16% oil was employed as feedstock for thermal cracking. The light neutral slack wax is lower in molecular weight that the Example 1 medium neutral slack wax (338 versus 453 for the MNSW) and has a higher paraffin content (85 versus 78 wt. %) and lower aromatics (3.8 versus 8.4 wt. %).

The reactor and thermal cracking conditions were similar to those previously described for Example 1. 50–80 ml/hr of slack wax feed along with 30 SCCM nitrogen was pumped down through a reactor tube filled with 45 cc of vycor chips. Vapor residence times were 5–10 seconds. The temperature in the center of the reactor was about 590° C. The temperature profile dropped off at either end of the reactor.

Product yields from two cracking runs at different flow rates are summarized in columns A and B of Table 10. The products from these runs were distilled to remove $C_{18}$-products. The distillation bottoms (approximately $C_{19}$+) from the lower conversion runs (Run B) were recracked, with yields shown in column C of Table 10. The bottoms from the products of Run C, combined with the bottoms from Run A, were cracked once more (Run D). Run C simulated the recycle operation practiced in commercial wax cracking.

The liquids collected from the slack wax cracking runs were fractionated at 1 atm and under a vacuum of 0.05–0.1 torr. Without further purification, these fractions were used individually or combined to give mixtures with desired average carbon lengths for polymerization by promoted aluminum chloride catalyst.

The polymerization procedures were similar to those described in Example 1. The lube product was hydrogenated at 240° C. and 400 psi hydrogen pressure with 2 wt. % Ni on Kieselguhr catalyst for four hours.

TABLE 10

Conditions and Product Yields for Thermally Cracked LNSW

| Run | A | B | C | D |
|---|---|---|---|---|
| Feed | LNSW | LNSW | Recycle | Twice Recyc. |
| Cracking Temp, °C. | 590 | 590 | 590 | 590 |
| Feed rate, ml/hr | 50 | 80 | 80 | 80 |
| $C_{19}$+ conversion, wt % | 35 | 28 | 27 | 27 |
| Yields, wt % | | | | |
| $C_1$ to $C_3$ | 9.1 | 6.1 | 5.7 | |
| $C_4$ | 1.9 | 1.2 | 1.3 | |
| $C_5$ | 2.2 | 1.4 | 1.4 | |
| $C_6$ | 3.1 | 2.4 | 2.7 | |
| $C_7$ to $C_{18}$ | 23.5 | 20.7 | 20.1 | |
| Total $C_5$ to $C_8$ | 23.5 | 20.7 | 20.1 | |
| Wt % selectivities: | | | | |
| $C_1$ to $C_3$ | 26.1 | 21.5 | 21.0 | |
| $C_4$ | 5.5 | 4.4 | 4.8 | |
| $C_5$ | 6.3 | 5.0 | 5.2 | |
| $C_6$ | 8.9 | 8.7 | 10.0 | |
| $C_7$ to $C_{18}$ | 52.3 | 60.2 | 59.0 | |
| Total $C_5$ to $C_{18}$ | 67.5 | 73.5 | 74.2 | |

Oxidative stability tests were carried out either by the B10 or by the DSC method. The oil was formulated by mixing 78.24 wt. % of sample basestock and 21.76 wt. % of the additive/ester package. For the B10 test, 30 g of the formulated oil was heated in a test tube to 163° C. (325° F.) with air bubbling through the oil at one liter/minute for 72 hours. The extent of oxidation was measured in term of % viscosity increase.

The DSC oxidation induction time of the formulated oils were measured using a DuPont 910 Scanning Differential Calorimeter with a pressurized sample cell. The DSC conditions are summarized below:

| | |
|---|---|
| Sample size | 1.0 mg |
| Atmosphere | 100% oxygen |
| Pressure | 500 psi |
| Initial temperature | 50° C. |
| Temperature program rate | 20° C./min |
| Final temperature | 175° C. |

The DSC induction time was the time required to reach the maximum heat flow under above conditions. Longer induction times indicate higher oxidative stability.

Thermal Cracking Yields-LNSW

The single-pass conversions of light neutral slack wax (LNSW) to $C_{18}$-products were 35% and 28% at feed rates of 50 and 80 ml/min, respectively (Runs A and B, Table 10). The lower conversion run gave slightly better selectivity to $C_5$–$C_{18}$ olefins than the high conversion run (74% vs 68%). The once-and twice-recycled wax (Runs C and D) cracked with conversions and selectivities to $C_5$–$C_{18}$ very similar to those of the fresh wax (Run B). This indicates that wax can be recycled for complete conversion with high selectivity to $C_5$–$C_{18}$ products.

The $C_5$ to $C_{18}$ products isolated by atmospheric and vacuum distillation are highly olefinic, as indicated by the similar molecular weights calculated by bromine number and by GC analysis. The amount of linear alpha-olefins produced in the lower conversion run (Run B) is slightly higher than that produced in Run A (90% vs 80–85%). The other components are branched, cyclic or aromatic-containing olefins. These olefin mixtures were used for 40 cS PAO synthesis without further purification.

Oligomerization of LNSW alpha-olefins

Yields of PAO from LNSW derived alpha-olefin oligomerization and properties were determined by varying $AlCl_3$ catalyst concentration from 2 wt. % to 10 wt. % (Table 11 ) using the olefins with 10.2 average carbon number produced in Run A as the feedstock.

TABLE 11

| Catalyst Concentration Vs Product Yields and Properties | | | | |
|---|---|---|---|---|
| Run | 1 | 2 | 3 | 1-decene |
| Wt % $AlCl_3$ | 2 | 5 | 10 | 2 |
| Molar Ratio $H_2O/AlCl_3$ | 0.6 | 0.6 | 0.6 | 0.6 |
| Reaction Temp., °C. | 50 | 50–60 | 50–100 | 50 |
| Reaction time, hrs | 16 | 16 | 16 | 4 |
| Lube Yields by GC | — | 98 | 97 | — |
| isolated lube yields | 36 | 93 | 86 | >95 |
| Lube Properties | | | | |
| Visc. @ 100° C., cS | 21.4 | 32.67 | 31.32 | |
| Visc. @ 40° C., cS | 210.43 | 342.91 | 336.14 | |
| VI | 121 | 134 | 131 | |
| Lube Properties After Hydrogenation | | | | |
| Visc. @ 100° C., cS | — | 34.49 | 31.77 | 40 |
| Visc. @ 40° C., cS | — | 373.80 | 337.69 | 440 |
| VI | — | 134 | 132 | 145 |
| Pour Point, C | — | −33 | −37 | −34 |

The 5 wt. % catalyst charge gave the best yield (93%) and temperature control to produce 33 cS product. With 2 wt. % catalyst charge the lube yield and viscosity were significantly lower (36% and 21 cS).

The lube VIs and pour points varied systematically with the average carbon length of feed olefins as shown in Table 12.

TABLE 12

| Run No. | 4* | 5* | 6* | 7* | 1-decene |
|---|---|---|---|---|---|
| Average Carbon Length | 9.7 | 10.4 | 11.4 | 10.2 | 10.0 |
| Carbon Number Range | 5–16 | 6–16 | 6–18 | 5–18 | 10 |
| Isolated Lube Yields, % | 93 | 93 | 86 | 90 | >90 |
| Lube Properties | | | | | |
| Visc. @ 100° C., cS | 32.31 | 32.67 | 40.71 | 36.2 | — |
| Visc. @ 40° C., cS | 359.67 | 342.91 | 448.59 | 404.47 | — |
| VI | 127 | 134 | 139 | 132 | — |
| Lube Properties after Hydrogenation | | | | | |
| Visc. @ 100° C., cS | 34.4 | 34.49 | 43.45 | 45.28 | 40 |

TABLE 12-continued

| Run No. | 4* | 5* | 6* | 7* | 1-decene |
|---|---|---|---|---|---|
| Visc. @ 40° C., cS | 388.38 | 373.80 | 499.98 | 545.2 | 440 |
| VI | 129 | 134 | 138 | 135 | 145 |
| Pour Point, °C. | −33 | −33 | −27 | −28 | −34 |
| Thermal Stability in % Viscosity Change | | | | | |
| @ 280° C. | 8 | 8 | 8 | 7 | 23 |
| @ 300° C. | 15 | — | — | 19 | 31 |

*Reaction conditions: 5 wt % $AlCl_3$, molar ratio of $H_2O/AlCl_3$ 0.6/1, 50–60° C., 16 hours reaction time.

Lube products from olefins with longer average carbon lengths (11.4 vs 9.7) had higher VI (138 vs 129) and higher pour points (−27° C. vs −33° C.). The lube product from an olefin mixture of 10.4 carbon had somewhat lower VI (134 vs 145) but similar pour point (−33° C. vs −34° C.), when compared to commercial PAO lube oligomer, prepared from 1-decene, with 40 cS viscosity.

The presence of $C_{17}$ and $C_{18}$ olefins in the feed raised the pour points of the lube product from −33° to −28° C. (Run 5 vs Runs 6 or 7 in Table 12). Run 7 also demonstrated that the complete olefin mixture ($C_5$ to $C_{18}$) from wax cracking can be used to produce PAO with VI and pour point similar to current PAO (VI of 135 vs 145, pour point of −28° C. vs −34° C.). About 65% of the $C_5$ and 35% of the $C_6$ product during cracking passed through the condenser in the gas phase. This material can be recovered and included in the liquid product. The resulting $C_5$–$C_{18}$ mixture would have had a slightly lower average carbon length.

The PAOs produced from wax-derived alpha-olefins had better thermal stability than the current commercial PAO from 1-decene. The wax-derived PAOs exhibited only 7–8% viscosity loss upon heating to 280° C. versus 23% viscosity loss for commercial 1-decene PAO. Thus, the lubes made here from cracked slack wax have VI and thermal stabilities comparable to those of commercial PAO which has been modified by aromatic alkylation for improved thermal stability.

In Table 13, a comparison is presented of the oligomerization of alpha-olefins prepared from single pass and recycle cracking runs of LNSW.

The VI, pour points and thermal stabilities of PAO lube from alpha-olefins by LNSW cracking with lower conversions are similar to those of PAO lube from alpha-olefins by LNSW cracking with higher conversions (Runs 8 and 9 vs Runs 5 and 7 of Table 12). The PAO lube derived from cracking of once-recycled wax is similar to those of PAO from fresh wax cracking (Run 10 vs Run 5 of Table 12). The 128 VI of PAO from twice-recycled material suggests a buildup of more highly branched products. The branched paraffins and naphthenes in the oil portion of the slack wax may crack less readily than the linear paraffins and thus appear in greater quantities as overall conversion is increased. The lube properties for wax cracked to extinction with recycle would be an average of those seen for single-pass conversion (e.g. Runs 4–9 of Tables 12 and 13) and those seen for lubes made from recracked bottoms (Runs 10–12 of Table 13).

TABLE 13

| Run No. | 8* | 9* | 10* | 11* | 12 | 1-decene |
|---|---|---|---|---|---|---|
| wax source | fresh LNSW 28% conversion | | Recyc. wax | twice recyc. wax | | — |
| Avg. Carbon Lgth. | 10.2 | 10.7 | 9.9 | 10.4 | 10.8 | 10.0 |

TABLE 13-continued

| Run No. | 8* | 9* | 10* | 11* | 12 | 1-decene |
|---|---|---|---|---|---|---|
| Carbon No. Range | 6-17 | 6-18 | 5-16 | 7-16 | 5-18 | 10 |
| Lube Yields, wt % | 92 | 91 | 91 | 90 | 87 | >90 |
| Lube Properties | | | | | | |
| Visc. @ 100° C., cS | 34.28 | 31.64 | 37.26 | 32.66 | 36.18 | — |
| Visc. @ 40° C., cS | 366.12 | 325.27 | 430.03 | 354.65 | 429.17 | — |
| VI | 135 | 136 | 130 | 131 | 126 | — |
| Lube Properties after Hydrogenation | | | | | | |
| Visc. @ 100° C., cS | 34.46 | 35.48 | 50.70 | 32.59 | 36.17 | 40 |
| Visc. @ 40° C., cS | 379.11 | 393.92 | 694.43 | 361.99 | 422.56 | 440 |
| VI | 132 | 132 | 127 | 128 | 128 | 145 |
| Pour Point, °C. | −36 | −29 | −33 | −45 | −41 | −34 |
| Thermal Stability in % Viscosity Change | | | | | | |
| @ 280° C. | 5.7 | 15 | 15 | — | — | 23 |
| @ 300° C. | 15.8 | 19 | 21 | — | — | 31 |

*Reaction conditions: 5 wt % $AlCl_3$, molar ratio of $H_2O/AlCl_3$ 0.6/1, 50-60° C., 16 hours reaction time.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for the production of high VI synthetic lubricants, comprising;

contacting the $C_5$–$C_{18}$ portion of the alpha-olefinic hydrocarbon product mixture from the thermal cracking of slack wax or recycled slack wax with an aluminum chloride oligomerization catalyst under oligomerizing conditions and separating a product comprising synthetic lubricant having a kinematic viscosity greater than about 20 cS at 100° C., pour point less than −15° C. and VI greater than 120, said cracking being carried out under conditions sufficient to provide a crackate containing at least 60 weight percent linear alpha-olefins.

2. The process of claim 1 comprising the further step of hydrogenating said synthetic lubricant in contact with hydrogenation catalyst and recovering hydrogenated lubricant having improved thermal stability.

3. The process of claim 2 wherein said thermal stability comprises less than 15% viscosity loss upon cracking said hydrogenated lubricant at 280° C. under nitrogen for 24 hours.

4. The process of claim 1 wherein said mixture comprises $C_6$–$C_{16}$ hydrocarbons having an average carbon number of about 10.

5. The process of claim 1 wherein said mixture contains at least 75 weight percent linear alpha olefins.

6. The process of claim 1 wherein said aluminum chloride is promoted with water in a mole ratio of water to aluminum chloride between about 10 and 0.1.

7. The process of claim 1 wherein said oligomerization conditions comprise temperature between about 0° C. and 250° C. for a time sufficient to produce said synthetic lubricant and less than 10 weight percent of said catalyst.

8. The process of claim 9 wherein said temperature is about 50° C.

9. The process of claim 1 wherein said slack wax is thermally cracked at a temperature between about 500° C. and 648° C. at a pressure from about 50 kPa to about 980 kPa, then fractionated to provide said product mixture comprising $C_5$–$C_{18}$ olefinic hydrocarbons containing linear alpha olefins.

10. A synthetic lubricant according to the process of claim 1.

11. A synthetic lubricant according to the process of claim 2.

12. A combined process for the production of high VI synthetic lubricant having improved thermal stability, comprising:

a) thermally cracking slack wax to produce an olefinic hydrocarbon mixture comprising a major portion of linear alpha olefins;

b) separating said mixture to produce $C_5$–$C_{18}$ hydrocarbon mixture comprising predominantly linear alpha olefins;

c) oligomerizing said $C_5$–$C_{18}$ mixture in contact with promoted aluminum chloride catalyst;

d) recovering a $C_{30}$+ oligomerization product comprising a synthetic lubricant having a kinematic viscosity greater than about 20 cS at 100° C. and VI greater than 120;

e) hydrogenating said oligomerization product to provide synthetic hydrocarbon lubricant having thermal stability comprising less than 15% viscosity loss upon cracking at a280° C. under nitrogen for 24 hours.

13. The process of claim 12 wherein step (b) mixture is separated to provide $C_6$–$C_{16}$ hydrocarbon mixture for oligomerization in contact with promoted aluminum chloride catalyst.

14. The process of claim 14 wherein said mixture comprises $C_6$–$C_{16}$ hydrocarbons having an average carbon number of about 10.

15. The process of claim 12 wherein step (c) mixture is oligomerized at a temperature between about 0° C. and 250° C. for a time sufficient to produce said synthetic lubricant.

16. The process of claim 15 wherein said temperature is about 50° C.

17. The process of claim 12 wherein said slack wax is thermally cracked at a temperature between about 500° C. and 648° C. at a pressure from about 50 kPa to about 980 kPa.

* * * * *